US012383044B2

(12) United States Patent
Salentine et al.

(10) Patent No.: US 12,383,044 B2
(45) Date of Patent: Aug. 12, 2025

(54) CONSTRUCTION TOOL BELT OR POUCH WITH INTEGRATED ATTACHMENT FEATURES

(71) Applicant: HAMMERHEAD INDUSTRIES, INC., Ventura, CA (US)

(72) Inventors: John A. Salentine, Goleta, CA (US); Kenneth S. Collin, Jr., Ojai, CA (US)

(73) Assignee: Hammerhead Industries, Inc., Ventura, CA (US)

( * ) Notice: Subject to any disclaimer, the term of this patent is extended or adjusted under 35 U.S.C. 154(b) by 0 days.

(21) Appl. No.: 17/741,274

(22) Filed: May 10, 2022

(65) Prior Publication Data

US 2022/0354240 A1 Nov. 10, 2022

Related U.S. Application Data

(60) Provisional application No. 63/186,582, filed on May 10, 2021.

(51) Int. Cl.
*A45F 3/14* (2006.01)

(52) U.S. Cl.
CPC ..... *A45F 3/14* (2013.01); *A45F 2003/144* (2013.01)

(58) Field of Classification Search
USPC ..... 224/163, 162
See application file for complete search history.

(56) References Cited

U.S. PATENT DOCUMENTS 1,482,130 A * 1/1924 Griest ..... A47L 3/04 182/4
4,953,765 A * 9/1990 Little ..... A45F 5/00 383/902
4,963,765 A * 10/1990 Kadakia ..... H03K 5/1534 326/121
5,201,448 A * 4/1993 Schue ..... B25H 3/00 224/660
5,370,286 A * 12/1994 Newman ..... A45F 3/14 119/857
5,437,401 A * 8/1995 Seltzer ..... A45F 3/14 294/149
5,603,545 A * 2/1997 Benson ..... A63C 11/021 224/257

(Continued)

*Primary Examiner* — Nathan J Newhouse
*Assistant Examiner* — Lester L Vanterpool
(74) *Attorney, Agent, or Firm* — Jaye G. Heybl; Stradling Yocca Carlson & Rauth

(57) ABSTRACT

Tool belts are disclosed that provided improved safety features and can be worn both as a conventional tool belts, but also have integral features that allow them to be mounted to structure (e.g. railing or fence) at a construction/work site when the tool belt is removed from the user. This allows the user to remove the belt during work to reduce fatigue and to reduce the danger that the belt will cause the user to be thrown off balance. The integral attachment mechanism allows the tool belt to be held in place near the worker so that the tools and supplies can be accessed and the tool belt will be held in place even if one of the tools falls. This eliminates the risk that the tool belt fall to the ground by the tool or by misplacement of the tool belt near a ledge. The tool belts according to the present invention can also include safety tethers or retractors for attachment to tools being used and stored in the tool belt.

13 Claims, 3 Drawing Sheets

(56) References Cited

U.S. PATENT DOCUMENTS 5,718,363 A * 2/1998 Graves ..... F41C 33/002 224/901.4
5,894,976 A * 4/1999 Harper ..... A45F 5/00 224/660
6,213,365 B1 * 4/2001 Stocke ..... A41D 13/0012 224/684
6,216,931 B1 * 4/2001 Trawinski ..... A45F 3/14 224/904
6,371,346 B1 * 4/2002 Sharma ..... A45F 3/14 224/195
7,658,307 B2 * 2/2010 Skupin ..... A45F 5/004 224/675
7,694,862 B2 * 4/2010 Bergeron ..... A45F 5/02 224/675
7,770,770 B2 * 8/2010 Murdoch ..... F41C 33/04 224/675
D711,092 S * 8/2014 Lockhart-Adams ..... D3/228
8,998,052 B1 * 4/2015 Mitchell ..... A45F 3/14 224/660
10,816,305 B1 * 10/2020 Beavers ..... F41C 33/002
2002/0174521 A1 * 11/2002 Vidal, Jr. ..... B25H 3/006 24/3.1
2003/0213827 A1 * 11/2003 Langmuir ..... A45F 3/02 224/625
2005/0242144 A1 * 11/2005 Panosian ..... A45F 5/02 224/684
2007/0158380 A1 * 7/2007 Calkin ..... A41D 13/0012 224/675
2009/0084822 A1 * 4/2009 Crye ..... A45F 5/021 224/660
2012/0168472 A1 * 7/2012 Mathews ..... A45F 5/021 224/162
2013/0008933 A1 * 1/2013 Clifford ..... A45F 3/14 224/576
2013/0181019 A1 * 7/2013 Salentine ..... A45F 5/021 2/102
2015/0342324 A1 * 12/2015 Zhao ..... A45F 3/02 224/153
2018/0071607 A1 * 3/2018 Alexander ..... A63B 69/38

* cited by examiner

CONSTRUCTION TOOL BELT OR POUCH WITH INTEGRATED ATTACHMENT FEATURES

This application claims the benefit of U.S. Provisional Patent Application Ser. No. 63/186,582, filed on May 10, 2021.

BACKGROUND OF THE INVENTION

Field of the Invention

This invention relates to construction tool belts or pouches, and in particular, construction tool belts that can be worn or mounted in conventional manner, such as around the waist, but also have integral attachment mechanisms for mounting to structures at a construction or work site.

Description of the Related Art

Tool belts of many different types are commonly found at construction or work sites, with most having a strap or belt around the waist and pockets or pouches that hang down from strap/belt around the hip area of the user. The pouches can have a plurality of different pockets for holding tools or supplies, with some tools being screwdrivers, hammers, wrenches, etc., and some of the supplies being pens, pencils, nails, screws, bolts, etc. The pouches are arranged so that they can be easily accessed by a user to access the tools or supplies during work. Various tool pouches can also be mounted or attached to user in different ways. The description below if directed to tool belts, but it is also understood that these features can apply to pouches in general.

FIGS. 1 and 2 shows one type of conventional work tool belt 10 with a waist strap 12 and first and second pouches 14, 16 hanging from the strap 12 in the hip area of the user. Each pouch 14, 16 can have a plurality of pockets 18 for holding the tools and supplies mentioned above. More recent pouches have been provided with tool tethers to attach the tool to the tool belt, either at the strap or at the pouch. Some of these can include fixed length lines, elastic lines, or can be the line of a retractor with the line being extendable and retractable against the force of the retractor's internal spring. Each of these are arranged to prevent the tool from falling to the ground below. This can be an important safety feature, particularly for workers at higher elevations where a dropped tool falling to the ground can not only present an inconvenience in retrieving the tool, but can also present a danger of serious injury to those below being struck by a falling tool.

Tool bags filled with tools and supplies can be heavy, and can add significant additional weight that must be carried by the user. This weight can result in fatigue for the user and sometimes can throw a user off balance during work. This can also present a danger of falling. Furthermore, while the tethers discussed above are essential for safety, they can also present a further danger of causing a user to lose his balance by the force of a dropped tool reaching the end of its tether and pulling on the user.

In some instances, the tool belts can be taken off by the user and laid on a work surface near where the user is conducting his work, in a location close enough to access the tools and supplies. This can allow the worker to conduct his work while not having to wear and bear the weight of the tool belt, and can also reduce the chances of the tool belt causing the user to lose his/her balance. However, this presents a risk of the tool belt falling to the ground below if it is misplaced or moved from its resting position. For instance, if a tool is tethered to the tool belt and the tool is then dropped, it can pull the entire tool belt to the ground with it.

SUMMARY OF THE INVENTION

The present invention generally directed to new tool belts that can be worn both as a conventional tool belts, but also has integral features that allow it to be mounted to structure or feature at a construction/work site. In some embodiments according to the present invention, the tool belts can contain integral attachment mechanism that allow the user to remove the tool belt and mount it to a nearby structure (e.g. railing, post, fence, etc.). This allows for the user to remove the belt during work to reduce fatigue and to reduce the danger that the belt will cause the user to be thrown off balance. The integral attachment mechanism allows for the tool belt to be held in place near the worker so that the tools and supplies can be accessed and the tool belt will be held in place even if one of the tools falls. This eliminates the risk that the tool belt falls to the ground by the tool or by misplacement of the tool belt as described above.

One embodiment of a tool belt according to the present invention comprises a waist strap for mounting to a user, and a plurality of pouches mounted to the waist strap to hold tools or supplies accessible by the user. A plurality of mounting straps are also included that are integral to said tool belt for mounting said tool belt to a structure when said belt is removed from the user.

The systems according to the present invention can comprise many different features as described below. These and other aspects and advantages of the invention will become apparent from the following detailed description and the accompanying drawings, which illustrate by way of example in the features of the invention.

DETAILED DESCRIPTION OF THE INVENTION

Figure 1:
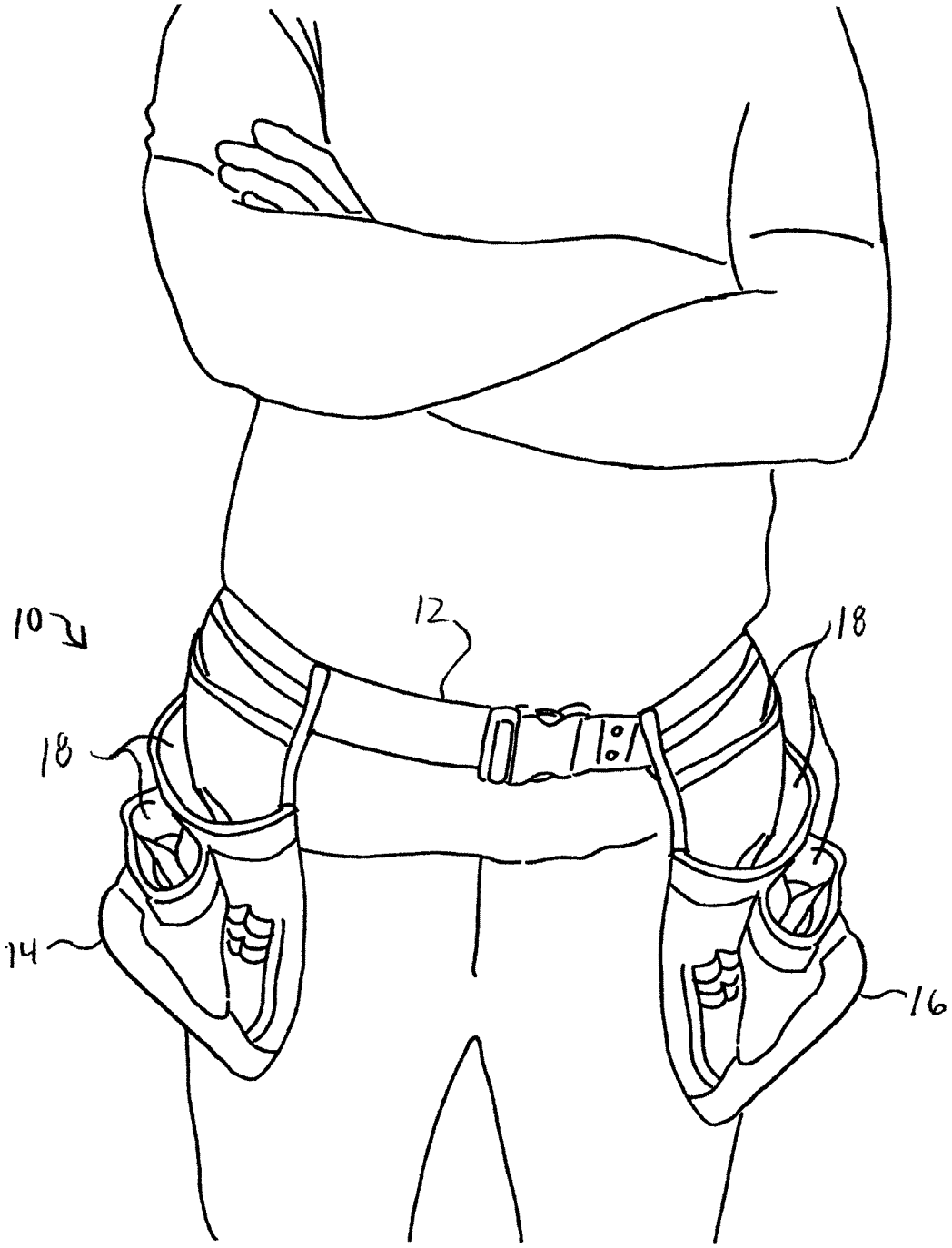
FIG. 1 is a front view of a conventional tool belt mounted to a user's waist.
Figure 2:
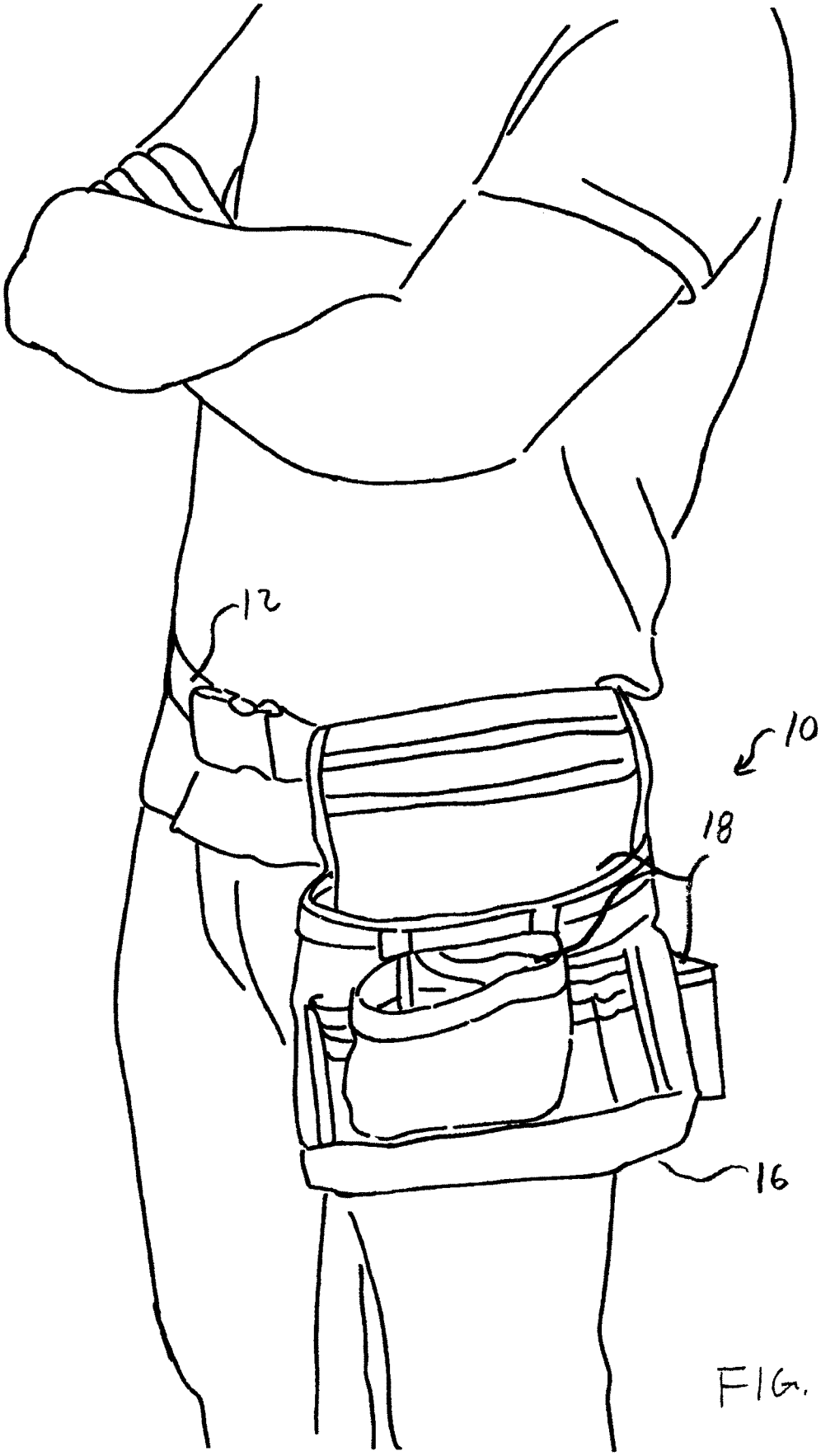
FIG. 2 is a side view of the tool belt shown in FIG. 1.

The present invention is directed to improved tool belts having features that allow them to be worn in a conventional matter at the user's waist, while also having integral features to allow for mounting the belt to a structure. These integral mounting features can comprise many different mechanisms including, but not limited to, straps, snaps, rings, buttons, buckles, brackets, connectors, etc., used either alone or combination. This allows for the tool belt to be mounted in place at a work site in a location where the work is being completed, and in a way that allows for easy access to the tools and supplies. By mounting the tool belt in place, the tool belt can be used with tools tethered to the tool belt while at the same time preventing the tool belt from being pulled to the ground by a dropped tool.

The present invention is described herein with reference to certain embodiments, but it is understood that the invention can be embodied in many different forms and should not be construed as limited to the embodiments set forth herein. As mentioned above, the description below is directed to tool belts, but it is also understood that these features can also apply to other devices arranged to carry personal articles, such as garments with pockets (e.g. vests) or other pouches. It is further understood that different embodiments can comprise different materials arranged in different ways, and can comprise different features. Different embodiments can also be arranged for mounting to other locations other than directly to a user.

It will be understood that when an element is referred to as being "on" or "connected to" another element, it can be directly on, or in contact with the other element or intervening elements may be present. In contrast, when an element is referred to as being "directly on", or "directly connected to" another element, there are no intervening elements present. Although the terms first, second, etc. may be used herein to describe various elements, and/or sections, these elements and/or sections should not be limited by these terms. These terms are only used to distinguish one element, or section from another element, or section. Thus, a first element or section discussed herein could be termed a second element, or section without departing from the teachings of the present invention.

Embodiments of the invention are described herein with reference to perspective view illustrations that are schematic illustrations of an embodiment of the invention. As such, the actual thickness or size of components can be different, and variations from the shapes of the illustrations as a result, for example, of manufacturing techniques and/or tolerances are expected. Embodiments of the invention should not be construed as limited to the particular shapes as illustrated herein but are to include deviations in shapes that result, for example, from manufacturing. A region or element illustrated or described as being generally square or rectangular can have rounded or curved features due to normal manufacturing tolerances. Thus, the features illustrated in the figures are schematic in nature and their shapes are not intended to illustrate the precise shape of a feature of a device and are not intended to limit the scope of the invention.

Figure 3:
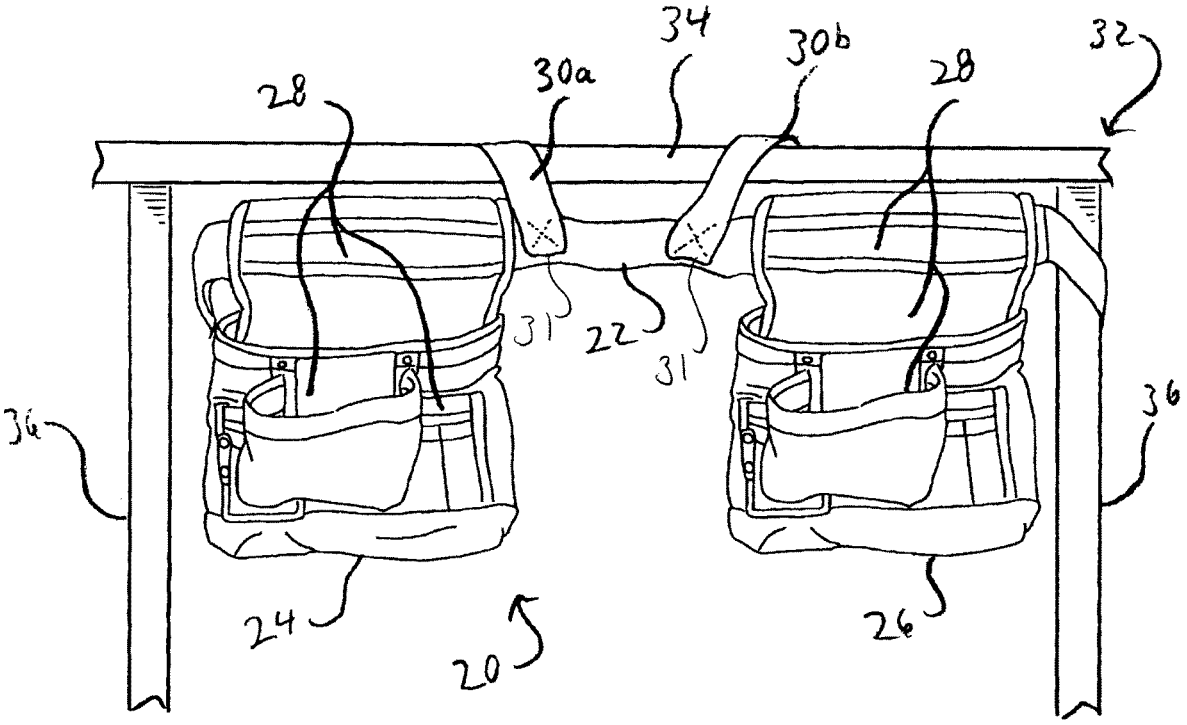
FIG. 3 is another front view of one of a tool belt with attachment mechanism according to the present invention.

FIG. 3 show one embodiment of a tool belt 20 according to the present invention comprising a waist strap 22 for mounting the tool belt to a user's waist much in the same way as convention tool belts. The tool belt 20 can also comprise pouches 24, 26 hanging from the strap 22 generally in the hip area of the user. Each pouch 24, 26 can have a plurality of pockets 28 for holding the tools and supplies mentioned above. The pouches can also be provided with tool tethers to attach the tool to the tool belt, either at the strap or the pouch. These can comprise the tethers mentioned above such as a fixed length lines, or elastic lines, or the tool can be attached to the line of a retractor (not shown) that is integral to the tool belt 20.

Each of these are arranged to prevent the tool from falling to the ground below. This can be an important safety feature, but can also present a danger of causing the user to be pulled off balance by the falling tool, or can pull the tool belt to the ground in those instances when the user removes the belt and places it on a nearby work surface.

Retractors can be arranged in different ways such that they cooperate with a tool from one of the pouches 24, 26. In some embodiments, the retractor can be arranged or mounted in the particular to one of the pouches 24, 26 such that the tools can be connected to the line of the retractor and the line of the retractor extends from the opening of the pouch under a user's pulling force applied to the tool. The retractor can be held in a separate pocket within the particular pouch, or can be mounted in the pouch. In other embodiments, the retractor can be mounted adjacent to the particular pouch and the retractor line can pass into the interior of the pouch. The tool can be similarly connected to the line, and the line can extend out the opening of the pouch under a pulling force applied to the tool. In both instances, the retractor line extends to allow the user to use the tool as desired, with the line preventing the tool from falling to the ground if the user drops the tool.

The tool belt 20 can also comprise many different mechanisms to attach the tool belt 20 to a structure when the tool belt user removes the tool belt but still wants it mounted in proximity in a secure manner. The attachment mechanisms can take many different forms and can be included in many different locations on the tool belt 20. In the embodiment shown, the tool belt 20 comprises a plurality of attachment straps 30*a*, 30*b* that can be used to attach the belt to a structure, such as a railing 32. It is understood that the straps 30*a*, 30*b* can be used to attach the tool belt 20 to many different structures beyond a railing, and in some embodiments the straps can have an adjustable length to allow for attachment to different structures of different thicknesses or at different angles. As mentioned above, the straps can comprise many different mechanisms including, but not limited to straps, snaps, rings, buttons, buckles, brackets, Velcro®, connectors, etc., used either alone or combination.

In the embodiment shown, first and second attachment/mounting straps 30*a*, 30*b* can each have an affixed end 31 that is permanently or semi-permanently affixed to the waist strap 22 at the user's back, although they can be attached in different locations on the tool belt 20. In the embodiments shown, the affixed end of the straps 30*a*, 30*b* can be sewn in place using conventional methods. The straps 30*a*, 30*b* can then pass over a horizontal section of the railing 34 and then end opposite the affixed, and connecting to the opposite side of the waist strap 22, or at one of the pouches 24, 26 at an attachment point. Each attachment point comprise a snap, buckle, Velcro® or ring and can allow for the tool belt 20 to be held to the railing 34 in the loop formed by the straps 30*a*, 30*b*.

In different embodiments additional straps can be included in different locations to provide additional holding locations for the tool belt 20. For example, different straps can be used to hold the tool belt 20 to the vertical portions of the railing 34. Alternatively, the waist strap 22 can also be used as another holding strap for the tool belt 20. As shown in FIG. 3, the waist strap can wrap around one of the vertical sections of the railing 34 and can form a loop by attaching to the other section of the waist strap 22 or can attached to another attachment mechanism in a different location on the tool belt, such as at a different location on the waist strap or at one of the pouches 24, 26. It is understood that many different attachment points can be provided for the straps 30*a*, 30*b* and the waist strap 22 to accommodate structures of differing thickness.

In some embodiments, the straps 30*a*, 30*b* can also be stored in a convenient manner when the user removes the tool belt 20 from the structure to wear in a conventional manner around the waist. In some embodiments the same connection points used when mounting the tool belt to a structure can be used to connect the straps 30*a*, 30*b* to store the straps when not in use. In other embodiments there can be separate connection points used specifically to store to straps 30*a*, 30*b* closely to the tool belt so that they do not interfere with normal use of the belt when it is around the user's waist.

It is also understood that in some embodiments, the straps 30*a*, 30*b* can be fully removable from the tool belt 20 so that they can be stored when not in use. When the straps 30*a*, 30*b* are needed to mount the tool belt to a structure, the straps can then be reattached to the tool belt 20. Many different attachment mechanisms can be used such as straps, buckles, buttons, Velcro, etc.

It is also understood that that the straps 30*a*, 30*b* can have a retraction mechanism (not shown) that can integral to the tool belt 20, such as at the waist strap 22 or one if the pouches 24, 26. When the straps 30*a*, 30*b* are not in use for mounting to a structure, they can be retracted so that they do not interview with use of the tool belt when around the user's waist.

It is understood that many different mechanisms and arrangements can be used in the different systems according to the present invention. Although the present invention has been described in detail with reference to certain configurations thereof, other versions are possible. Therefore, the spirit and scope of the invention should not be limited to the versions described above.

We claim:

1. A tool belt, comprising:

a waist strap for mounting to a user, a plurality of pouches mounted to the waist strap to hold tools or supplies accessible by the user;

an attachment point; and a plurality of mounting straps integral to said tool belt for mounting said tool belt to a structure when said belt is removed from the user with tool belt in an orientation to allow said pouches to retain their contents and be accessible by the user, wherein each of said mounting straps comprises a first affixed end affixed to said waist strap, with the end opposite the fixed end removably affixable to said waist strap, one of said pouches, or said attachment point when mounting said tool belt to a structure;

at least two storage connection points, each of which is on said waist strap or one of said pouches and each of which is used to connect to a respective one of said mounting straps to store its respective mounting strap closely to the tool belt so that it does not interfere with use of said belt when is mounted to said user.

2. The tool belt of claim 1, wherein at least one of said mounting straps is attached to said waist strap.

3. The tool belt of claim 1, wherein at least one of said mounting straps is attached to one of said pouches.

4. The tool belt of claim 1, wherein said mounting straps are removable.

5. The tool belt of claim 1, further comprising a plurality of mounting points for said mounting straps.

6. The tool belt of claim 1, wherein said waist strap is arranged to also be used to attach said tool belt to said structure.

7. A tool belt, comprising:

a waist strap for mounting to a user, a plurality of pouches mounted to the waist strap to hold tools or supplies accessible by the user, at least one of said pouches comprising an integral tool tether or retractor; and a plurality of mounting straps integral to said tool belt for wrapping around a structure to mount said tool belt to said structure when said tool belt is not being worn by the user, with said tool belt in an orientation to allow said pouches to retain their contents and be accessible by the user, wherein each of said mounting straps comprises a first end affixed to said waist strap with the end opposite the affixed end removably connectable to said waist strap, or one of said pouches at least two storage connection points, each of which is on said waist strap or one of said plurality pouches and each of which is used to connect to a respective one of said mounting straps to store its respective mounting strap to said waist strap.

8. The tool belt of claim 7, wherein at least one of said mounting straps is attached to said waist strap.

9. The tool belt of claim 7, wherein at least one of said mounting straps is attached to one of said pouches.

10. The tool belt of claim 7, wherein said mounting straps are removable.

11. The tool belt of claim 7, further comprising a plurality of attachment points for said mounting straps.

12. The tool belt of claim 7, wherein said waist strap is arranged to also be used to attach said tool belt to said structure.

13. A tool belt, comprising:

a waist strap for mounting said tool belt to a user, a plurality of pouches each of which has an opening and is mounted to the waist strap to hold tools or supplies accessible by the user through said opening;

at least one retractor integral to one said pouches and comprising a line that can be extendable from said one of said pouches through its said opening, said line being retractable when said pulling force is removed;

a plurality of mounting straps integral to said tool belt for mounting said tool belt to a structure proximate to the user when said tool belt is removed from the user, wherein each of said mounting straps comprises a first end affixed to said waist strap or one of said pouches, with the end opposite the affixed end removably connectable to said waist strap, or one of said pouches at least two storage connection points on said waist strap each of which is arranged to connect to one of said mounting straps to store its respective mounting strap so that it does not interfere with use of said belt when it mounted to said user.

* * * * *